US009806438B2

(12) United States Patent
Duncan et al.

(10) Patent No.: US 9,806,438 B2
(45) Date of Patent: Oct. 31, 2017

(54) GROUND BRACKET FOR AN OUTLET OF A RACK POWER DISTRIBUTION UNIT AND RELATED METHOD

(71) Applicant: SCHNEIDER ELECTRIC IT CORPORATION, West Kingston, RI (US)

(72) Inventors: Brian Lee Duncan, Highland, IL (US); Daniel J. Rohr, Wildwood, MO (US)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 0 days.

(21) Appl. No.: 15/128,326

(22) PCT Filed: Apr. 2, 2014

(86) PCT No.: PCT/US2014/032656
§ 371 (c)(1),
(2) Date: Sep. 22, 2016

(87) PCT Pub. No.: WO2015/152913
PCT Pub. Date: Oct. 8, 2015

(65) Prior Publication Data

US 2017/0125923 A1 May 4, 2017

(51) Int. Cl.
*H01R 4/64* (2006.01)
*H01R 13/655* (2006.01)
(Continued)

(52) U.S. Cl.
CPC ..... *H01R 4/64* (2013.01); *H01R 4/30* (2013.01); *H01R 13/655* (2013.01); *H01R 24/78* (2013.01);
(Continued)

(58) Field of Classification Search
CPC ..... H01R 4/64; H01R 4/30
See application file for complete search history.

(56) References Cited

U.S. PATENT DOCUMENTS 4,917,615 A 4/1990 Franks, Jr.
5,797,756 A 8/1998 Nad
(Continued)

OTHER PUBLICATIONS

Notification of Transmittal of the International Search Report and the Written Opinion of the International Searching Authority from corresponding PCT/US2014/032656 dated Aug. 22, 2014.

*Primary Examiner* — William H Mayo, III
*Assistant Examiner* — Hiram E Gonzalez
(74) *Attorney, Agent, or Firm* — Lando & Anastasi, LLP

(57) ABSTRACT

An electronic device includes a chassis, a first outlet provided in the chassis, and a power source coupled to the first outlet. The first outlet has a first ground terminal. The device further includes a ground bracket configured to connect first ground terminal of the first outlet to the chassis to ground the first outlet. The electronic device further may include a second outlet provided in the chassis and spaced from the first outlet. The second outlet is coupled to the power source, and has a second ground terminal. The ground bracket is configured to connect the first ground terminal of the first outlet to the second ground terminal of the second outlet and to the chassis. A method of grounding outlets of the electronic device is further disclosed.

14 Claims, 4 Drawing Sheets

(51) Int. Cl.

| | |
|---|---|
| ***H01R 24/78*** | (2011.01) |
| ***H01R 4/30*** | (2006.01) |
| ***H01R 43/02*** | (2006.01) |
| ***H01R 43/16*** | (2006.01) |
| ***H01R 43/26*** | (2006.01) |
| *H01R 103/00* | (2006.01) |

(52) U.S. Cl.
CPC ..... *H01R 43/02* (2013.01); *H01R 43/16* (2013.01); *H01R 43/26* (2013.01); *H01R 2103/00* (2013.01)

(56) References Cited

U.S. PATENT DOCUMENTS

| | | | | |
|---|---|---|---|---|
| 5,924,877 | A | 7/1999 | Byrne et al. | |
| 6,443,746 | B1 * | 9/2002 | Yu | H01R 25/006 439/107 |
| 7,500,854 | B2 * | 3/2009 | Gottstein | H01R 25/006 439/13 |
| 7,581,977 | B1 * | 9/2009 | Wu | H01R 13/7036 439/106 |
| 7,683,254 | B2 * | 3/2010 | Shimizu | H01R 4/64 174/40 CC |
| 8,038,454 | B2 * | 10/2011 | Jiang | H01R 25/003 439/106 |
| 9,352,374 | B2 * | 5/2016 | Munn | H01R 4/64 |
| 2008/0094774 | A1 | 4/2008 | Bucciferro | |
| 2011/0223784 | A1 | 9/2011 | Jiang et al. | |

* cited by examiner

GROUND BRACKET FOR AN OUTLET OF A RACK POWER DISTRIBUTION UNIT AND RELATED METHOD

CROSS-REFERENCE TO RELATED APPLICATIONS

This application is a U.S. National Stage Application under 35 U.S.C. §371 of International Application No. PCT/US2014/032656, filed Apr. 2, 2014, titled GROUND BRACKET FOR AN OUTLET OF A RACK POWER DISTRIBUTION UNIT AND RELATED METHOD, which is hereby incorporated herein by reference in its entirety.

BACKGROUND OF THE DISCLOSURE

1. Field of Disclosure

The present disclosure is directed to rack power distribution units, and generally to a ground bracket that is used for an AC outlet of a rack power distribution unit and a method of grounding.

2. Discussion of Related Art

Referring to FIG. 1, a rack power distribution unit (rPDU) 10 includes two outlets 12, 14 having respective grounding tabs 16, 18. The outlets 12, 14 are bonded to protective earth by way of respective wires 20, 22 connected between the grounding tabs 16, 18 of the outlets and a metal threaded stud 24 to a chassis 26 of the outlets. Each stranded wire 20, 22 typically includes a 12-gauge stranded wire that is cut to desired length, a ring terminal at one end of the chassis 26, and a female 0.250-inch receptacle faston at an opposite end of the chassis. Each outlet 12, 14 is required to have one bonded connection to the chassis 26 pursuant to existing safety regulations.

Referring to FIG. 2, congestion created by bundles of wires within the rPDU makes it more difficult to route heavy gauge wires. This congestion further makes it difficult to bend the heavy gauge wires between outlets and their respective chassis grounding terminals. Often it is necessary to create excessively long ground harnesses in order to access grounded terminals next to the outlets. This along with the numerous other wires in the device makes installation difficult. As shown, a typical wire routing configuration can congest the internal chassis 26 making it difficult to route normal ground bond wires, e.g., wire 20. Further, this congestion makes it difficult to employ two-dimensional rigid PCB (printed circuit boards) 28 for grounding purposes.

SUMMARY OF THE DISCLOSURE

One aspect of the present disclosure is directed to an electronic device comprising a chassis, a first outlet provided in the chassis, and a power source coupled to the first outlet. The first outlet has a first ground terminal. The device further comprises a ground bracket configured to connect first ground terminal of the first outlet to the chassis to ground the first outlet.

Embodiments of the electronic device further may include a second outlet provided in the chassis. The second outlet may be coupled to the power source, and has a second ground terminal. The second outlet may be spaced from the first outlet. The ground bracket may be configured to connect the first ground terminal of the first outlet to the second ground terminal of the second outlet and to the chassis. The chassis may include a chassis ground terminal. The ground bracket may be configured to be secured to the chassis ground terminal. The ground bracket may be secured to the chassis ground terminal by a fastener. The ground bracket may be secured to the chassis ground terminal by a weld. The ground bracket may be secured to the chassis ground terminal by a stud. The first outlet may be disposed in a first raised portion of the chassis and the second outlet may be disposed in a second raised portion of the chassis. The bracket may include a strip of metal configured to conform to a contour of the chassis including the first raised portion and the second raised portion. In one embodiment, the first outlet may be a C19 outlet and the second outlet may be a C13 outlet. The bracket may include a first tab portion configured to be secured to the first ground terminal of the first outlet and a second tab portion configured to be secured to the second ground terminal of the second tab portion. The bracket may be rectangular in cross section and fabricated from a brass alloy.

Another aspect of the disclosure is directed to a method of grounding outlets within a chassis of an electronic device. In one embodiment, the method comprises: positioning a ground bracket within the chassis of the electronic device; connecting the ground bracket to a first ground terminal of a first outlet of the electronic device; and securing the ground bracket to the chassis.

Embodiments of the method further may include connecting the ground bracket to a second ground terminal of a second outlet. Securing the ground bracket to the chassis may include securing the ground bracket to a chassis ground terminal provided in the chassis. Securing the ground bracket to the chassis may include fastening the ground bracket to the chassis ground terminal with a fastener. Securing the ground bracket to the chassis may include welding the ground bracket to the chassis ground terminal. Securing the ground bracket to the chassis may include fastening the ground bracket to the chassis ground terminal with a stud. The first outlet may be disposed in a first raised portion of the chassis and the second outlet may be disposed in a second raised portion of the chassis. The method further may include configuring the bracket to conform to a contour of the chassis including the raised first portion of the first outlet and the second raised portion of the second outlet. In one embodiment, the first outlet may be a C19 outlet and the second outlet may be a C13 outlet. Connecting the ground bracket to the first ground terminal of the first outlet may include securing a first tab portion of the bracket to the first ground terminal. Connecting the ground bracket to the second ground terminal of the second outlet may include securing the second tab portion of the bracket to the second ground terminal. The bracket may be rectangular in cross section and fabricated from a brass alloy.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
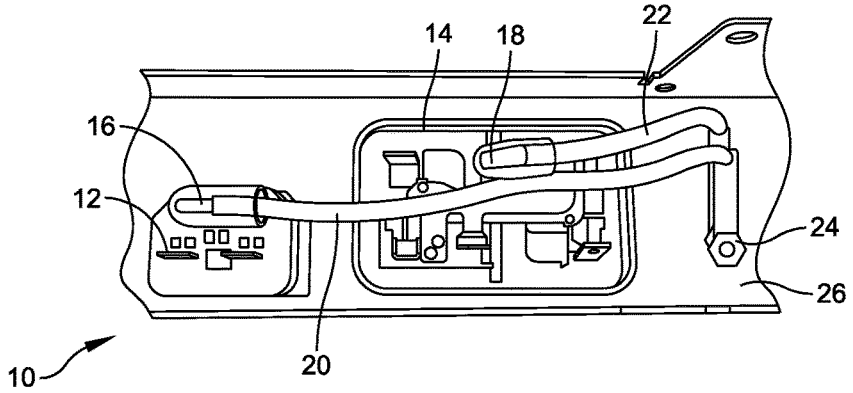
FIG. 1 (PRIOR ART)
FIG. 1 is a partial top plan view of a prior art outlet wiring scheme that is used within a rack power distribution unit, showing grounding wires within the outlet.

This disclosure is not limited in its application to the details of construction and the arrangement of components set forth in the following description or illustrated in the drawings. The principles set forth in this disclosure are capable of being provided in other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Rack power distribution units ("rPDUs") continue to become more complex with higher power requirements. These added requirements are contributing to already limited space in the chassis for routing wiring harnesses or inserting electronic printed circuit assemblies in the same space. Additionally, higher power requires thicker wires, which make the wires more difficult to bend in tight places. For each AC outlet, a 12-gauge stranded ground wire is attached between the earth tab of the outlet and chassis. The length of these ground wires are typically long in order to support the difficult bending of the wire itself. This additional length added to an already congested channel of wires makes it difficult to build without risk of mishaps.

One embodiment of a ground bracket disclosed herein replaces these difficult wire assemblies with a stamped, form-fitted brass bracket. The ground bracket replaces the individual ground wires, and is capable of running along a contour of the chassis of the electronic device, thus freeing up space for components within the chassis. Further, the ground bracket can support multiple outlets in accordance with any required safety regulations. This construction promotes ease at installation, alleviates wire routing problems, and improves unit to unit build consistency.

High density rPDU's are very congested and have limited space for routing thick and often difficult to bend wires. Added to the complexity is the need for additional outlets in the same space. With prior routing schemes, each outlet is required to have a bonded connection between the ground terminal and chassis. The ground bracket eliminates the complexity of routing wires across the outlets to access the metal chassis.

The stamped, form fitted brass ground bracket of the present disclosure can be designed to hug or conform to the contour of existing AC outlets, while still accessing nearby threaded chassis ground lugs. The construction of the ground bracket reduces the risk of congestion or interference with nearby obstacles, including wiring and printed circuit boards. This overall approach reduces congestion and improves manufacturability, while maintaining its purpose of providing ground bond between the outlets and the metal chassis.

In one embodiment, a piece of brass stock is formed, and used in place of typical wire. The brass ground bracket provides a bonded path between the earth potential on the outlet and a threaded ground stud on the chassis. In a certain embodiment, the ground bracket is stamped from 20-gauge brass stock. Tooling is then used to roll and bend as desired so that the ground bracket conforms to an interior profile of the chassis of the rPDU, for example. Specifically, the 20-gauge brass stock is stamped and formed. A ring terminal end of the ground bracket is aligned over a threaded ground stud provided on the metal chassis of the electronic device, while the two roll formed ends of the bracket are slid over and mated to the 0.250-inch safety ground tabs of the two AC outlets. The bracket is then pressed downward till the two ends mate with their reciprocal pieces. In one embodiment, a 5/16-inch nut with star washer is then inserted on the threaded stud and tightened as required.

Figure 3:
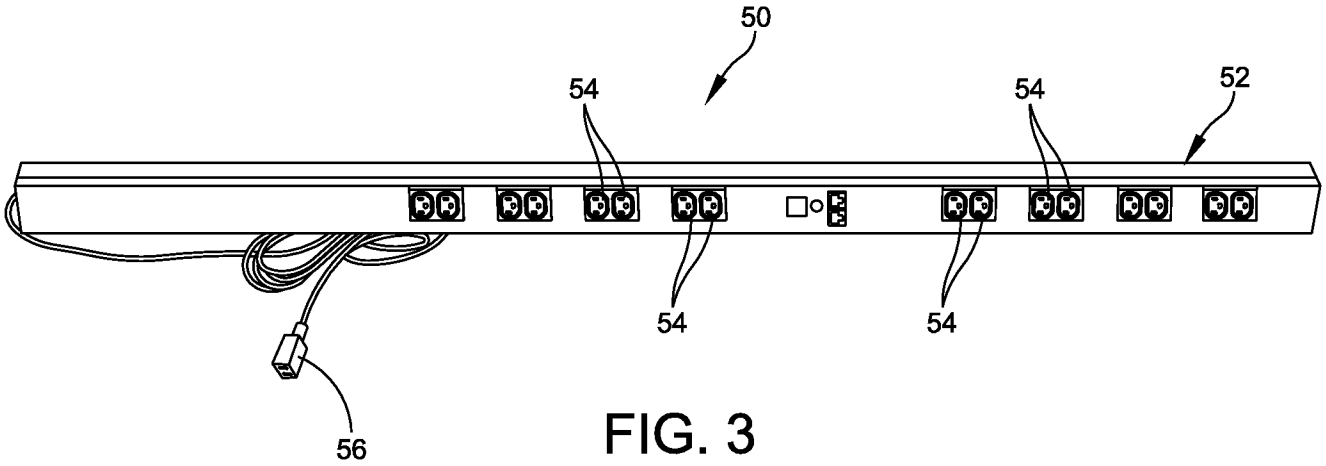
FIG. 3 is a perspective view of an electronic device of an embodiment of the present disclosure.

Referring to the drawings and more particularly to FIG. 3, an electronic device, such as a rack power distribution unit (rPDU), is generally indicated at 50. As shown, the electronic device 50 includes a housing or chassis, generally indicated at 52, that is designed to support a plurality of outlets, each indicated at 54 in FIG. 3. It should be understood that the electronic device 50 may include other types of outlets, such as telecommunication outlets. The electronic device 50 further may include other operator-related devices, such as a user interface. As shown, the chassis 52 of the electronic device 50 is an elongate structure, which can include any number of outlets 54. It should be understood that the electronic device 50 can embody any number of configurations and still fall within the scope of the present disclosure. In one embodiment, the outlets are C13 outlets; however, as described below, the outlets can be any type of outlet, including C19 outlets. The electronic device 50 includes a power source 56 that is electronically and mechanically connected to the outlets 54 in the usual manner to provide power to the outlets. In one embodiment, the power source 56 may include a power cord that is configured to be plugged into an electrical power outlet.

Figure 2:
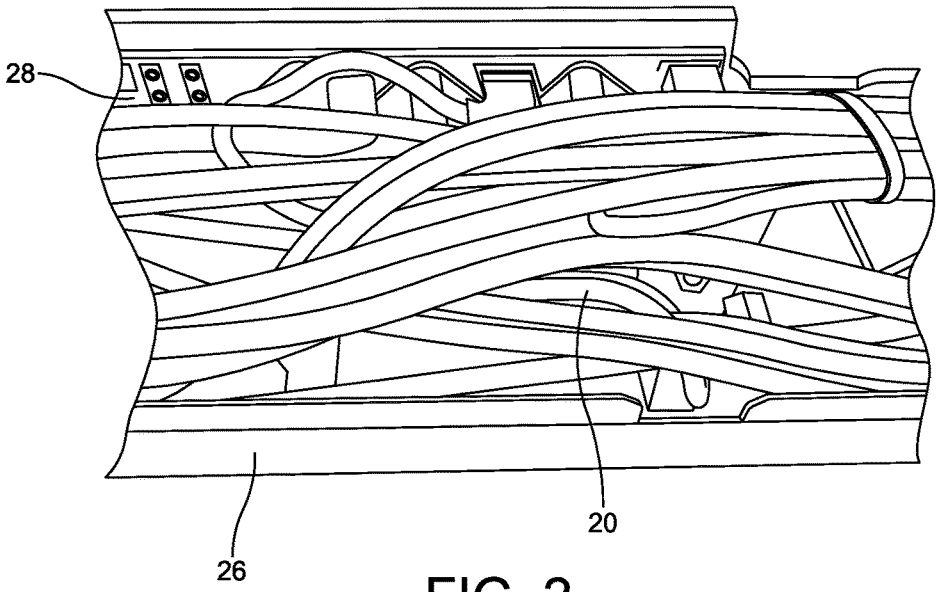
FIG. 2 (PRIOR ART)
FIG. 2 is an enlarged partial top plan view of a fully assembled rack power distribution unit shown in FIG. 1.
Figure 4:
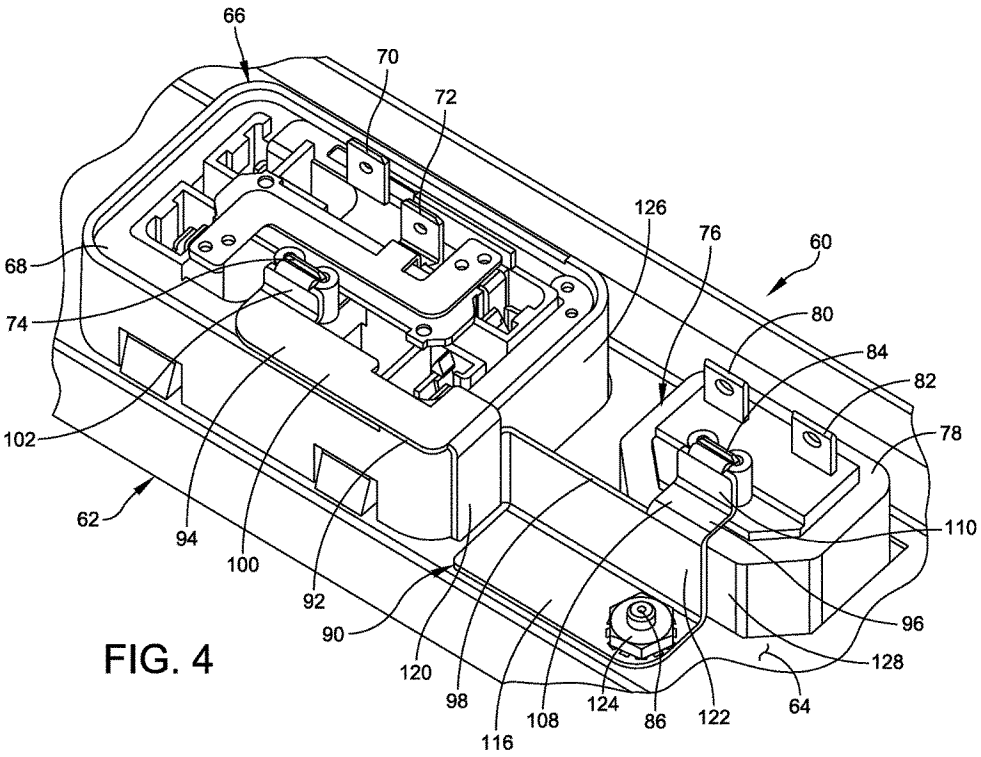
FIG. 4 is a perspective view of the electronic device with a cover removed to reveal an outlet having a ground bracket of an embodiment of the present disclosure.

Referring to FIG. 4, in one embodiment, an electronic device, generally indicated at 60, includes a chassis, generally indicated at 62, which is a box-like structure that includes a wall 64 on which the components of the electronic device are provided. As described above, the electronic device 60 can embody an rPDU. However, it should be understood that the principles disclosed herein can be applied to other electronic devices, such as uninterruptible power supplies (UPSs), having outlets. In one embodiment, the electronic device 60 includes a first, larger outlet generally indicated at 66 that is provided on a first raised portion 68 formed on the wall 64 of the chassis 62. The first outlet 66 has first mains or line ("hot") terminal 70, a first neutral terminal 72, and a first ground terminal 74. In a particular embodiment, the first outlet 66 is a C19 outlet. However, the first outlet 66 may be any type of outlet known in the art depending on the intended purpose of the electronic device 60. It should be understood that the wall 64 of the chassis 62 is earth-grounded by a wire, such as the earth ground wire 20 shown in FIGS. 1 and 2.

In one embodiment, the electronic device 60 further includes a second, smaller outlet generally indicated at 76 that is provided on a second raised portion 78 formed on the wall 64 of the chassis 62. The second outlet 76 has a second mains or line ("hot") terminal 80, a second neutral terminal 82, and a second ground terminal 84. In the shown embodiment, the second outlet 76 is a C13 outlet. However, as with the first outlet 66, the second outlet 76 may embody any type of outlet known in the art of power distribution. The electronic device 60 further includes a chassis ground terminal 86 to ground the first and second outlets 66, 76 with the metal chassis 62. As is well known, with mains powered equipment, exposed metal parts are connected to ground to prevent a user from contacting dangerous voltage if electrical insulation associated with the outlet fails.

It should be understood that the electronic device 60 may be provided with more than the two outlets 66, 76, each having a desired purpose, and still fall within the scope of the present disclosure. For example, the electronic device 60 may be similarly configured as electronic device 50, with sixteen outlets. In addition, as mentioned above, the electronic device 60 may be configured with any type of outlet depending on the intended use of the electronic device. As shown, the second outlet 76 is spaced from the first outlet 66 a predetermined distance, with additional outlets, not shown in FIG. 4, being spaced equidistance or some other predetermined distance from the first outlet and the second outlet, if provided. For example, the spacing of the outlets may be similar to the outlets 54 shown with electronic device 50.

As shown, the electronic device 50 further includes a ground bracket, generally indicated at 90, which is configured to connect first ground terminal 74 of the first outlet 66 to the chassis ground terminal 86, and configured to connect the second ground terminal 84 of the second outlet 76 to the chassis ground terminal. As mentioned above, the ground bracket 90 replaces large-gauge wires that are used to separately connect the first ground terminal 66 and the second ground terminal 76 to the chassis ground terminal 86. In one embodiment, the ground bracket 90 is stamped from 20-gauge brass, rectangular in cross section, and form-fitted to the interior of the chassis 62 to enable the connection of the first and second ground terminals 74, 84 to the chassis ground terminal 86. As shown, the ground bracket 90 includes a body 92 having a first end portion 94 configured to be secured to the first ground terminal 74 of the first outlet 66 and a second end portion 96 configured to be secured to the second ground terminal 84 of the second outlet 76. The body 92 of the ground bracket 90 further includes a middle portion 98, which is disposed between and integrally connected to the first end portion 94 and the second end portion 96.

Figure 5:
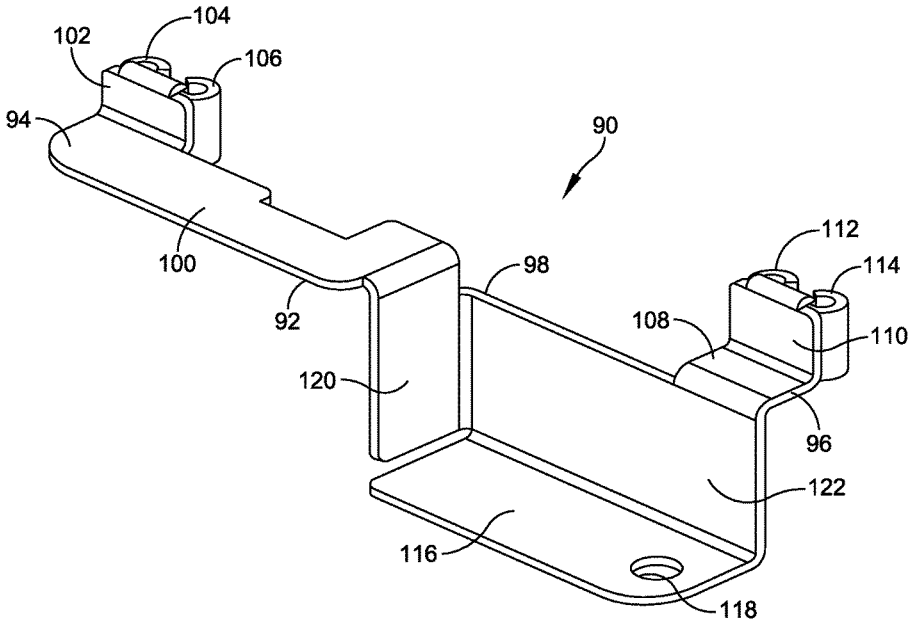
FIG. 5 is a perspective view of the ground bracket.
Figure 6:
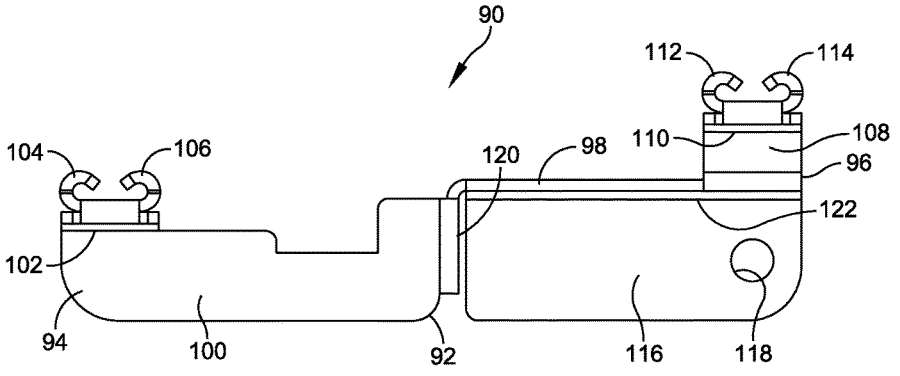
FIG. 6 is a top plan view of the ground bracket.

Referring to FIGS. 5 and 6, the first end portion 94 of the body 92 of the ground bracket includes a horizontal segment 100 and a vertical segment 102 integrally formed with the horizontal segment. The vertical segment 102 of the first end portion 94 includes a pair of inwardly curled tabs 104, 106, which are configured to be secured to the first ground terminal 74 of the first outlet 66. The arrangement is such that when the ground bracket 90 is in the shown operating position (see FIG. 4), the tabs 104, 106 and the vertical segment 102 of the first end portion 94 engage the first ground terminal 74 of the first outlet 66. The horizontal segment 100 of the first end portion 94 is constructed to lie flat against the first raised portion 68 of the first outlet 66, with the vertical segment 102 elevating the tabs 104, 106 so they engage the first ground terminal 74.

Similarly, the second end portion 96 includes a smaller horizontal segment 108 and a vertical segment 110 integrally formed with the smaller horizontal segment. The vertical segment 110 of the second end portion 96 includes a pair of inwardly curled tabs 112, 114, which are configured to be secured to the second ground terminal 84 of the second outlet 76. As with the first end portion 94, the tabs 112, 114 and the vertical segment 110 of the second end portion 96 engage the second ground terminal 84 of the second outlet 76 (see FIG. 4). The smaller horizontal segment 108 of the second end portion 96 is constructed to lie flat against the second raised portion 78 of the second outlet 76, with the vertical segment 110 elevating the tabs 112, 114 so they engage the second ground terminal 84. It should be understood that the first end portion 94 and the second end portion 96 may be configured in any suitable manner in which the end portions are mechanically and electrically connected to the first and second ground terminals 74, 84, respectively.

The middle portion 98 of the body 92 of the ground bracket 90 is configured to be secured to the chassis ground terminal 86. In one embodiment, the middle portion 98 of the body 92 of the ground bracket 90 includes a horizontal segment 116, which is formed with an opening 118, a first vertical segment 120 that is integrally connected to the horizontal segment 100 of the first end portion 94, and a second vertical segment 122 that is integrally connected to the smaller horizontal segment 108 of the second end portion 96. The first end portion 94, the second end portion 96, and the middle portion 98 are formed by bending operations applied to 20-gauge brass stock material to achieve the configuration shown in FIGS. 4-6.

Referring back to FIG. 4, the opening 118 of the horizontal segment 116 of the middle portion 98 is provided to secure the ground bracket 90 to the chassis ground terminal 86 by a fastener 124, such as a screw fastener (when the ground terminal is threaded). In another embodiment, the ground bracket is secured to the chassis ground terminal by a weld or by a stud. As shown, the first vertical segment 120 of the middle portion 98 is constructed to lie flat against a wall 126 of the first raised portion 68 before transitioning to the horizontal segment 100 of the first end portion 94. The second vertical segment 122 of the middle portion 98 is constructed to lie flat against a wall 128 of the second raised portion 78 before transitioning to the horizontal segment 108 of the second end portion 96.

It should be further understood that for outlets 66, 76, whether a C19- or a C13-type outlet, the outlet heights, orientations, sizes, and other parameters can vary depending on the product requirements for the electronic device 60. The ground bracket 90 can be modified to conform to the particular outlet design.

A method of grounding outlets within a chassis of an electronic device, such as electronic device 60, is further disclosed. In one embodiment, the method includes positioning the ground bracket 90 within the chassis 62 of the electronic device 60. The method further includes connecting the ground bracket 90 to the first ground terminal 74 of the first outlet 66 of the electronic device. The method further includes securing the ground bracket 90 to the chassis ground terminal 86 of the chassis 62 by using a fastener, such as a screw fastener. The ground bracket 90 can also be used, based on the shown configuration, to connect the second ground terminal 84 of the second outlet 76 to the chassis ground terminal 86 when connecting the first ground terminal 74 to the chassis ground terminal.

It should be understood that the ground bracket can be configured to secure one of the outlets, e.g., the first outlet, to the chassis ground terminal, with a separate ground bracket being provided to secure the other outlet, e.g., the second outlet, to the chassis ground terminal. Moreover, the ground bracket can be configured to secure any number of outlets to one another. For example, the ground bracket can be constructed to ground the ground terminals of three outlets to the chassis ground terminal.

In one embodiment, the brass ground bracket design can be altered to accommodate other outlet configurations. In one embodiment, the brass ground bracket is fabricated from stamped 20-gauge brass metal material, which functions as a bonding outlet ground tab to the supporting chassis. Other suitable metal materials may be used in place of brass. The ground bracket can be formed to hug an interior of the chassis, and configured to capture two or more outlet ground tabs or to capture two or more outlet modules. In a certain embodiment, the brass ground bracket can be formed as part of the chassis. In another embodiment, the brass ground bracket is secured to the chassis by spot-welding, rather than a fastener or a stud.

The ground bracket of the present disclosure supports existing and current design rPDUs, which employs C13 and C19 outlets. C13 outlets have a variety of common uses including connecting C13 coupler strips, which are commonly used with rack-mount gear to save space and for international standardization, and connecting computer equipment to the output of an uninterruptible power supply (UPS), with larger UPSs having C19 outlets as well. C19 outlets are used for some IT applications in which higher currents are required, such as high-power workstations and servers, UPSs, power distribution units (PDUs), power strips, large network routers, switches, blades, and similar equipment. The ground bracket of embodiments of the present disclosure can be used in such devices or any other device having outlets. For example, the ground bracket can be used in UPSs.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

The invention claimed is:

1. An electronic device comprising:

a chassis;

a first outlet provided in the chassis, the first outlet having a first ground terminal;

a second outlet provided in the chassis, the second outlet being coupled to the power source and having a second ground terminal, the second outlet being spaced from the first outlet;

a power source coupled to the first outlet; and a ground bracket configured to connect the first ground terminal of the first outlet to the chassis to ground the first outlet and to connect the first ground terminal of the first outlet to the second ground terminal of the second outlet to the chassis, wherein the first outlet is disposed in a first raised portion of the chassis and the second outlet is disposed in a second raised portion of the chassis, the bracket including a strip of metal configured to conform to a contour of the chassis including the first raised portion and the second raised portion, the strip of metal including a horizontal segment configured to lie along a bottom of the chassis and to ground the bracket to the chassis, a first vertical segment coupled to the first ground terminal of the first outlet by a first curled tab, and a second vertical segment coupled to the second ground terminal of the second outlet by a second curled tab.

2. The electronic device of claim 1, wherein the chassis includes a chassis ground terminal, and wherein the ground bracket is configured to be secured to the chassis ground terminal.

3. The electronic device of claim 2, wherein the ground bracket is secured to the chassis ground terminal by a fastener.

4. The electronic device of claim 2, wherein the ground bracket is secured to the chassis ground terminal by a weld.

5. The electronic device of claim 2, wherein the ground bracket is secured to the chassis ground terminal by a stud.

6. The electronic device of claim 1, wherein the first outlet is a C19 outlet and the second outlet is a C13 outlet.

7. The electronic device of claim 1, wherein the bracket is rectangular in cross section and fabricated from a brass alloy.

8. A method of grounding outlets within a chassis of an electronic device, the method comprising:

positioning a ground bracket within the chassis of the electronic device;

connecting the ground bracket to a first ground terminal of a first outlet of the electronic device;

connecting the ground bracket to a second ground terminal of a second outlet, the ground bracket being configured to connect the first ground terminal of the first outlet to the chassis to ground the first outlet and to connect the first ground terminal of the first outlet to the second ground terminal of the second outlet of the chassis; and securing the ground bracket to the chassis, wherein the first outlet is disposed in a first raised portion of the chassis and the second outlet is disposed in a second raised portion of the chassis, the bracket including a strip of metal configured to conform to a contour of the chassis including the first raised portion and the second raised portion, the strip of metal including a horizontal segment configured to lie along a bottom of the chassis and to ground the bracket to the chassis, a first vertical segment coupled to the first ground terminal of the first outlet by a first curled tab, and a second vertical segment coupled to the second ground terminal of the second outlet by a second curled tab.

9. The method of claim 8, wherein securing the ground bracket to the chassis includes securing the ground bracket to a chassis ground terminal provided in the chassis.

10. The method of claim 9, wherein securing the ground bracket to the chassis includes fastening the ground bracket to the chassis ground terminal with a fastener.

11. The method of claim 9, wherein securing the ground bracket to the chassis includes welding the ground bracket to the chassis ground terminal.

12. The method of claim 9, wherein securing the ground bracket to the chassis includes fastening the ground bracket to the chassis ground terminal with a stud.

13. The method of claim 8, wherein the first outlet is a C19 outlet and the second outlet is a C13 outlet.

14. The method of claim 8, wherein the bracket is rectangular in cross section and fabricated from a brass alloy.

* * * * *